US011009825B2

(12) United States Patent
Wang

(10) Patent No.: US 11,009,825 B2
(45) **Date of Patent: *May 18, 2021**

(54) IMAGE-FORMING APPARATUS INCLUDING DRIVING PORTION PROVIDED AT ONLY ONE SIDE OF DEVELOPING CARTRIDGE FOR MOVING DEVELOPING ROLLER TOWARD AND AWAY FROM PHOTOSENSITIVE DRUM

(71) Applicant: BROTHER KOGYO KABUSHIKI KAISHA, Nagoya (JP)

(72) Inventor: Yuwen Wang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,202

(22) Filed: May 18, 2020

(65) Prior Publication Data

US 2020/0278635 A1 Sep. 3, 2020

Related U.S. Application Data

(63) Continuation of application No. 16/558,902, filed on Sep. 3, 2019, now Pat. No. 10,678,181.

(30) Foreign Application Priority Data

Sep. 28, 2018 (JP) ..... JP2018-183059

(51) Int. Cl.

| | |
|---|---|
| ***G03G 15/04*** | (2006.01) |
| ***G03G 21/16*** | (2006.01) |
| ***G03G 15/08*** | (2006.01) |

(52) U.S. Cl.

CPC ..... *G03G 21/1619* (2013.01); *G03G 15/0889* (2013.01); *G03G 21/1671* (2013.01); *G03G 21/1676* (2013.01)

(58) Field of Classification Search

CPC ..... G03G 21/1619; G03G 21/1676; G03G 21/16; G03G 21/1609; G03G 21/1671;

(Continued)

(56) References Cited

U.S. PATENT DOCUMENTS

| | | | |
|---|---|---|---|
| 10,031,472 | B2 | 7/2018 | Itabashi et al. |
| 10,175,637 | B2 | 1/2019 | Nishiyama et al. |

(Continued)

FOREIGN PATENT DOCUMENTS

| | | | |
|---|---|---|---|
| JP | 2011-59510 | A | 3/2011 |
| JP | 2013-54058 | A | 3/2013 |

*Primary Examiner* — Hoang X Ngo

(74) *Attorney, Agent, or Firm* — Merchant & Gould P.C.

(57) ABSTRACT

An image-forming apparatus includes a developing cartridge, a photosensitive drum, a drawer and a driving portion. The developing cartridge includes: a developing roller rotatable about an axis extending in a first direction; a casing; a first cam positioned at one end of the casing in the first direction; and a pressing surface pivotable in accordance with pivotal movement of the first cam. The drawer includes: a drawer frame to which the developing cartridge is detachably attachable; and a depressed surface with which the pressing surface is contactable. The driving portion is configured to pivotally move the first cam about an axis extending in the first direction. The pressing surface is configured to contact the depressed surface to move the developing roller from a contacting position in contact with the photosensitive drum to a separated position in separation from the photosensitive drum by the pivotal movement of the first cam.

9 Claims, 8 Drawing Sheets

(58) Field of Classification Search
CPC ..... G03G 21/1647; G03G 21/1814; G03G 21/1642; G03G 21/1821; G03G 15/0887; G03G 15/0889; G03G 15/0891
See application file for complete search history.

(56) References Cited

U.S. PATENT DOCUMENTS

| | | | | |
|---|---|---|---|---|
| 2011/0064457 | A1 | 3/2011 | Okabe et al. | |
| 2013/0051849 | A1 | 2/2013 | Itabashi et al. | |
| 2018/0136604 | A1* | 5/2018 | Lee ..... | G03G 15/0173 |

* cited by examiner

IMAGE-FORMING APPARATUS INCLUDING DRIVING PORTION PROVIDED AT ONLY ONE SIDE OF DEVELOPING CARTRIDGE FOR MOVING DEVELOPING ROLLER TOWARD AND AWAY FROM PHOTOSENSITIVE DRUM

CROSS REFERENCE TO RELATED APPLICATION

This application is a continuation of U.S. patent application Ser. No. 16/558,902, filed Sep. 3, 2019, which claims priority from Japanese Patent Application No. 2018-183059 filed Sep. 28, 2018. The entire contents of the aforementioned applications are incorporated herein by reference.

TECHNICAL FIELD

The present disclosure relates to an image-forming apparatus.

BACKGROUND

There have been conventionally known electro-photographic type image-forming apparatuses such as laser printers and LED printers. Such an image-forming apparatus includes a developing cartridge which includes a developing roller for supplying toner. Such conventional image-forming apparatuses are disclosed in prior arts.

An image-forming apparatus disclosed in a prior art includes a drum unit provided with a photosensitive drum. A developing cartridge is attachable to and detachable from the drum unit. A developing roller of the developing cartridge is in contact with the photosensitive drum upon attachment of the developing cartridge to the drum unit.

In an image-forming apparatus disclosed in another prior art, a developing cartridge is attachable to a drum cartridge including a photosensitive drum. A developing roller and a photosensitive drum are in contact with each other upon attachment of the developing cartridge to the drum cartridge. The drum cartridge to which the developing cartridge is attached is mounted in a main body of the image-forming apparatus.

SUMMARY

According to the conventional image-forming apparatuses disclosed in the above-identified publications, the developing roller of the developing cartridge is movable between a contacting position where the developing roller is in contact with the photosensitive drum and a separated position where the developing roller is separated from the photosensitive drum. However, components for moving the developing roller are positioned at each side of the drum unit or the drum cartridge. Thus, a driving force from the main body of the image-forming apparatus must be transmitted to the components positioned at each side.

In view of the foregoing, it is an object of the disclosure to provide an image-forming apparatus capable of moving the developing roller between the contacting position in contact with the photosensitive drum and the separated position separated therefrom by a driving force applied only to one side of the developing cartridge.

In order to attain the above and other objects, according to one aspect, the disclosure provides an image-forming apparatus including a developing cartridge, a photosensitive drum, a drawer, and a driving portion. The developing cartridge includes a developing roller, a casing, a first cam, and a pressing surface. The developing roller is rotatable about an axis extending in a first direction. The casing is configured to store developing agent therein. The first cam is positioned at one end of the casing in the first direction. The first cam is pivotally movable about an axis extending in the first direction between a first position and a second position. The pressing surface is pivotable in accordance with pivotal movement of the first cam. The photosensitive drum is rotatable about an axis extending in the first direction. The drawer includes a drawer frame, and a depressed surface. The developing cartridge is detachably attachable to the drawer frame such that an outer peripheral surface of the developing roller faces an outer peripheral surface of the photosensitive drum. The pressing surface is contactable with the depressed surface. The driving portion is configured to pivotally move the first cam from the first position to the second position. When the driving portion pivotally moves the first cam from the first position to the second position, the pressing surface comes in contact with the depressed surface to move the developing roller from a contacting position in contact with the photosensitive drum to a separated position in separation from the photosensitive drum.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
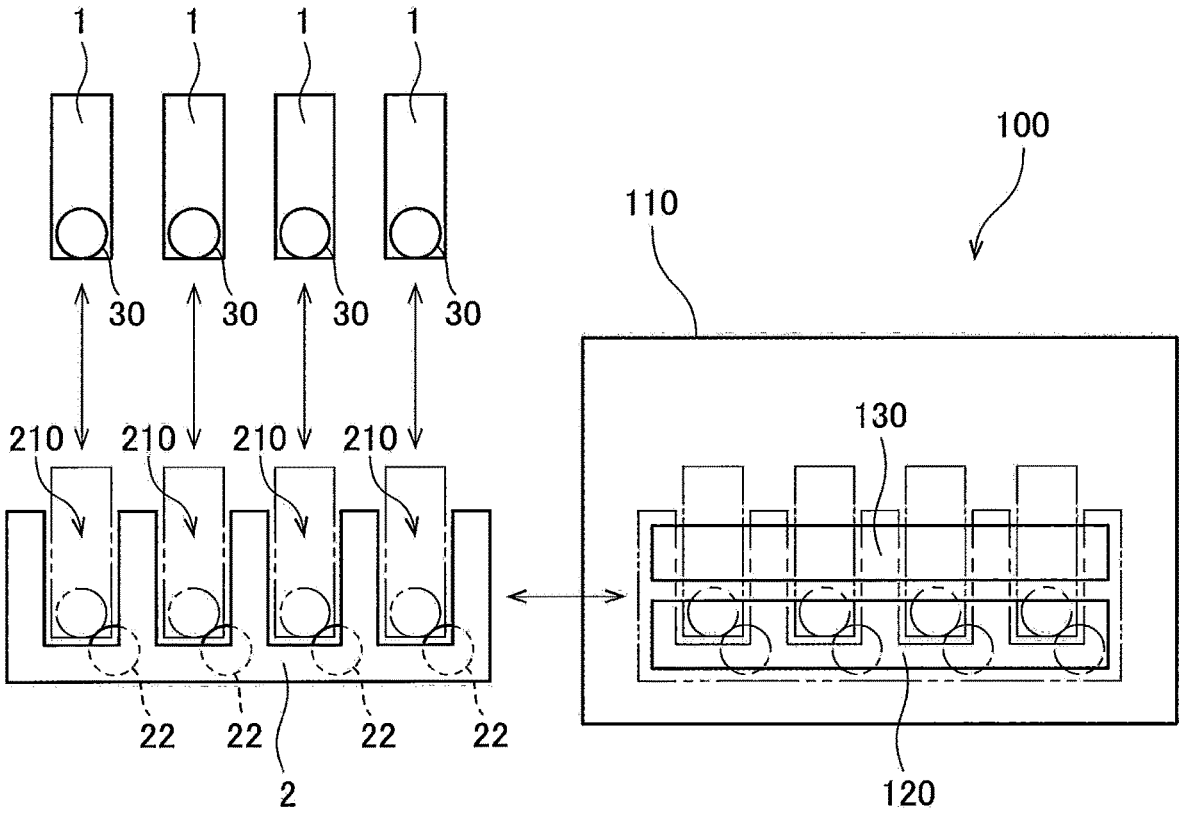
FIG. 1 is a conceptual diagram of an image-forming apparatus according to one embodiment.

Hereinafter, an image-forming apparatus 100 according to one embodiment of the present disclosure will be descried in detail with reference to accompanying drawings.

In the following description, a direction in which a rotational axis of a developing roller 30 will be referred to as "first direction". The first direction is also a direction in which a rotational axis of a photosensitive drum 22 extends. With respect to the developing roller 30, a direction in which a portion exposed outside of a casing 10 and a portion positioned inside the casing 10 are arranged in line with each other will be referred to as "second direction". The second direction is also a direction crossing a portion of an outer peripheral surface of the developing roller 30, the portion being exposed outside of the casing 10. Further, the second direction is a "separating direction" in which the developing roller 30 is separated away from a peripheral surface of the photosensitive drum 22. The first direction and the second direction cross each other. Further, a direction crossing the first direction and the second direction will be referred to as "third direction". The third direction is also an insertion direction of a developing cartridge 1 into a slot 210 of a drawer 2.

1. Outline of Image-Forming Apparatus

FIG. 1 is a conceptual diagram of the image-forming apparatus 100. The image-forming apparatus 100 according to the embodiment is an electro-photographic type printer, such as a laser printer and an LED printer.

As illustrated in FIG. 1, the image-forming apparatus 100 includes four developing cartridges 1, the drawer 2, a housing frame 110, a first driving portion 120 and a second driving portion 130.

The developing cartridges 1 are attachable to and detachable from the drawer 2. The drawer 2 is in a form of a cartridge attachable to and detachable from the housing frame 110. The drawer 2 has four slots 210 and includes four photosensitive drums 22. Each of the four developing cartridges 4 is inserted in and removed from a corresponding one of the slots 210. The drawer 2 having the four developing cartridges 1 attached thereto is attachable to the housing frame 110. The four developing cartridges 1 accommodate therein developing agents (toners) of different colors (for example, cyan, magenta, yellow and black), respectively. Incidentally, the four developing cartridges 1 may accommodate developing agent of the same color. Further, the number of developing cartridges 1 may be from one to three or not less than five.

The image-forming apparatus 100 is configured to form an image on a printing sheet with the developing agents supplied from the four developing cartridges 1.

The first driving portion 120 is configured to apply a driving force to each photosensitive drum 22 (described later) and a gear portion 40 of each developing cartridge 1 in a state where the drawer 2 with the four developing cartridges 1 attached thereto is attached to the housing frame 110. The first driving portion 120 includes a motor (not illustrated), a plurality of gears (not illustrated), and a drive shaft (not illustrated). Driving force of the motor is transmitted to the photosensitive drums 22 and the gear portions 40 through the plurality of gears.

The second driving portion 130 is configured to apply a driving force to a separation cam 50 (described later) of each developing cartridge 1 in the state where the drawer 2 to which the four developing cartridges 1 are attached is attached to the housing frame 110. The second driving portion 130 includes a motor (not illustrated) and a plurality of gears (not illustrated). Driving force of the motor is transmitted to a cam gear 60 of each developing cartridge 1 through the plurality of gears. The first driving portion 120 and the second driving portion 130 are positioned at one side in the first direction of the drawer 2 attached to the housing frame 110. Details of the second driving portion 130 will be described later.

2. Drawer

Figure 2:
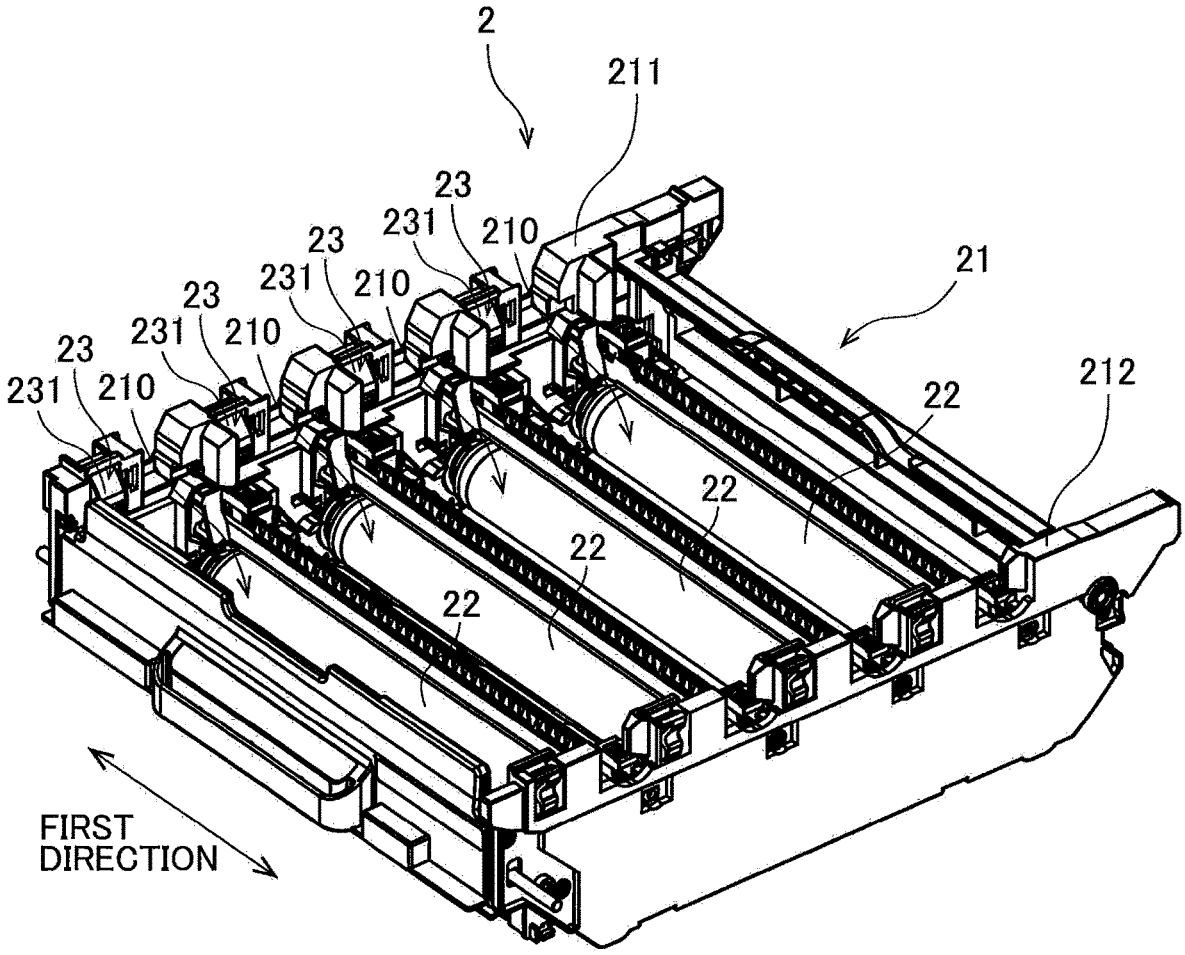
FIG. 2 is a perspective view of a drawer in the image-forming apparatus according to the embodiment.

FIG. 2 is a perspective view of the drawer 2. As illustrated in FIG. 2, the drawer 2 includes a drawer frame 21, the four photosensitive drums 22, and a plurality of pressure mechanisms 23.

The drawer frame 21 includes a first side frame 211 and a second side frame 212 spaced away from the first side frame 211 in the first direction. The first side frame 211 and second side frame 212 both extend in a direction perpendicular to the first direction. The four slots 210 are formed each at a position between the first side frame 211 and the second side frame 212 in the first direction. Each developing cartridge 1 is attachable to a corresponding one of the slots 210.

Each photosensitive drum 22 is provided for a corresponding one of the slots 210. Each of the photosensitive drums 22 extends in the first direction at a position between the first side frame 211 and the second side frame 212. Each photosensitive drum 22 is rotatable about an axis extending in the first direction. Each photosensitive drum 22 has a cylindrical outer peripheral surface extending in the first direction. The outer peripheral surface is a surface coated with a photosensitive material. Each developing cartridge 1 is attachable to the drawer 2 for a corresponding one of the four photosensitive drums 22. Upon attachment of the developing cartridge 1, an outer peripheral surface of the developing roller 30 faces the outer peripheral surface of the photosensitive drum 22.

Incidentally, the drawer 2 may have one to three slots 210, or not less than five slots 210. That is, the drawer 2 may include one to three photosensitive drums 22, or not less than five photosensitive drums 22.

Each of the pressure mechanisms 23 is configured to press the casing 10 of a corresponding one of the developing cartridges 1. Each pressure mechanism 23 includes a pressure member 231 and a spring (not illustrated). In a state where the developing cartridge 1 is attached to the corresponding slot 210 of the drawer frame 21, the pressure member 231 is configured to press the casing 10 of the developing cartridge 1 in the second direction by an urging force of the spring. Hence, the outer peripheral surface of the developing roller 30 is brought into contact with the outer peripheral surface of the photosensitive drum 22.

3. Developing Cartridge

Figure 3:
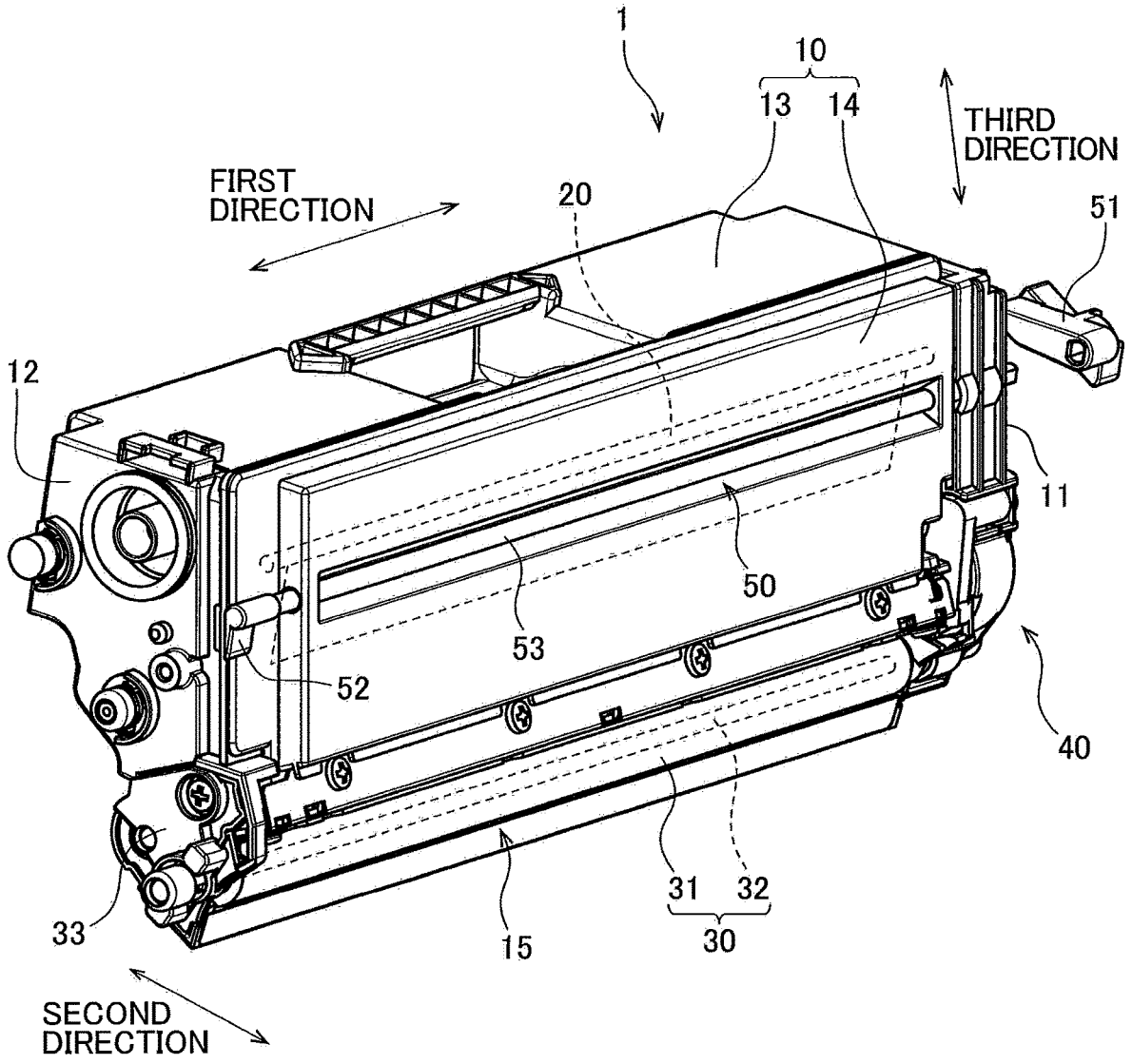
FIG. 3 is a perspective view of a developing cartridge in the image-forming apparatus according to the embodiment.
Figure 4:
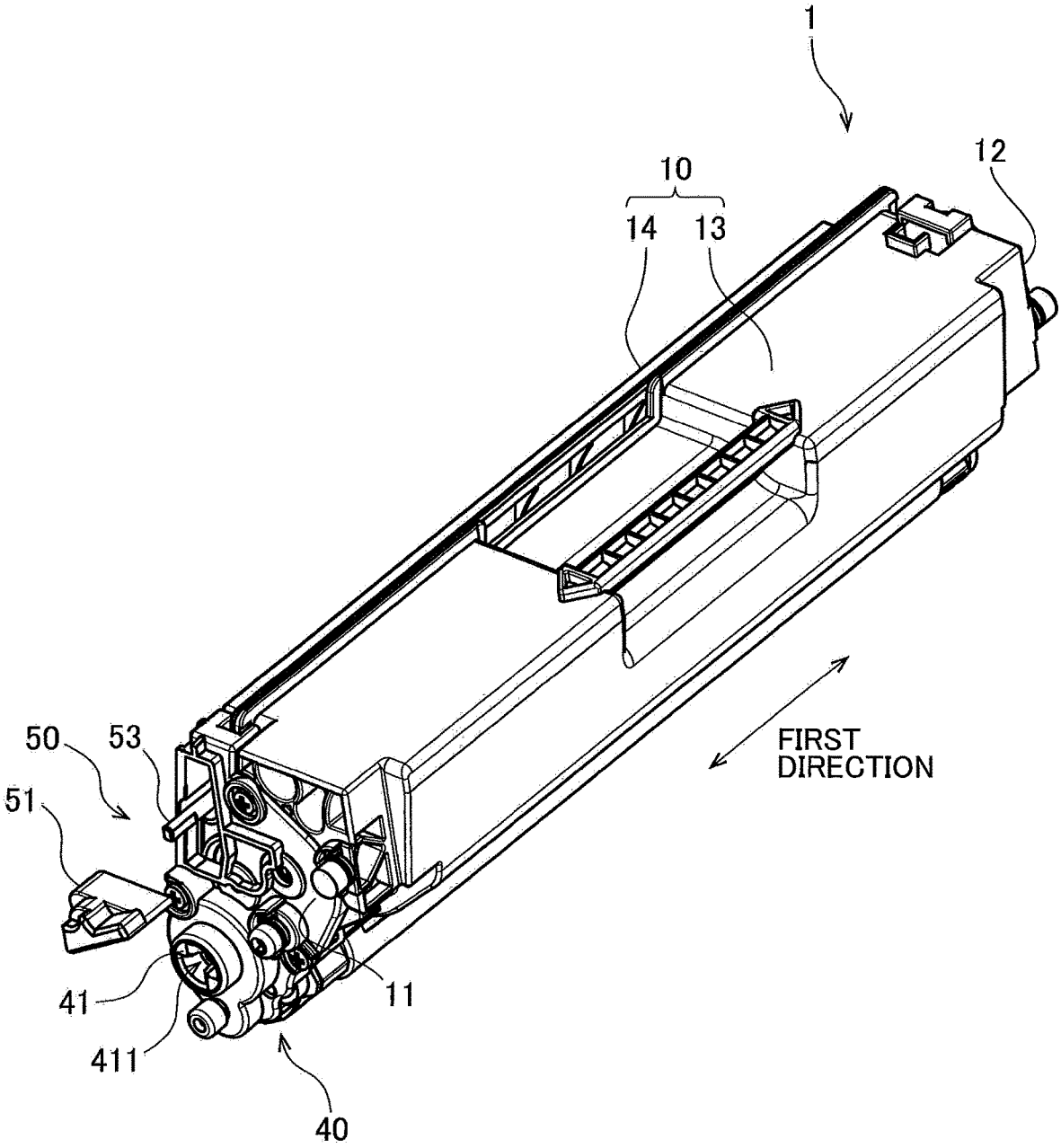
FIG. 4 is another perspective view of the developing cartridge in the image-forming apparatus according to the embodiment.

FIGS. 3 and 4 are perspective views of the developing cartridge 1. As illustrated in FIGS. 3 and 4, each developing cartridge 1 includes the casing 10, an agitator 20, the developing roller 30, the gear portion 40, and the separation cam 50. Incidentally, in FIGS. 3 and 4, the separation cam 50 is illustrated with only a first cam 51 (described later) disassembled.

The casing 10 is configured to accommodate the developing agent therein. The casing 10 has a first outer surface 11 and a second outer surface 12 spaced away from each other in the first direction. The first outer surface 11 is positioned at one end in the first direction of the casing 10, and the second outer surface 12 is positioned at another end in the first direction of the casing 10. The casing 10 includes a container portion 13 and a lid portion 14. The container portion 13 has the first outer surface 11 and the second outer surface 12. The developing agent is accommodated in an interior of the container portion 13. The interior is covered by the lid portion 14. The casing 10 has an opening 15 positioned at one end in a third direction of the casing 10. An interior of the casing 10 is communicable with an outside of the casing 10 through the opening 15.

The agitator 20 is configured to agitate developing agent accommodated in the casing 10. At least a part of the agitator 20 is positioned inside the casing 10. The agitator 20 is rotatable about an axis extending in the first direction. The agitator 20 includes an agitator shaft and an agitation blade (indicated by broken lines in FIG. 3). The agitator shaft extends in the first direction in the casing 10. The agitation blade extends radially outwardly from the agitation shaft. Rotation of the agitator shaft causes the agitation blade to agitate the developing agent accommodated in the casing 10.

The developing roller 30 is positioned at the opening 15. The developing roller 30 is spaced away from the agitator 20 in the third direction. The developing roller 30 is rotatable about an axis extending in the first direction. The developing roller 30 includes a developing roller body 31 and a developing roller shaft 32. The developing roller body 31 is hollow cylindrical in shape and extends in the first direction. The developing roller body 31 is made from elastic material such as rubber. The developing roller shaft 32 is a solid cylindrical member penetrating through the developing roller body 31 in the first direction. The developing roller shaft 32 is made from metal or electrically conductive resin. The developing roller body 31 is fixed to the developing roller shaft 32 without relative rotation. That is, the developing roller body 31 is rotatable together with the developing roller shaft 32.

The developing roller body 31 has an outer peripheral surface whose portion is exposed to an outside of the casing 10 through the opening 15. A remaining portion of the outer peripheral surface of the developing roller body 31 is positioned inside the casing 10. That is, the outer peripheral surface of the developing roller body 31 has a portion exposed to the outside of the casing 10 and a remaining portion located inside the casing 10. The exposed portion and the remaining portion are aligned with each other in the second direction. The exposed portion is at one end of the developing roller body 31 in the second direction, and the remaining part is at another end of the developing roller body 31 in the second direction. The second direction may also be referred to as a direction crossing the exposed portion of the developing roller body 31.

The developing roller shaft 32 has one end portion in the first direction on which a developing roller gear (not illustrated) is mounted. The developing roller gear is one of a plurality of gears constituting the gear portion 40. The developing roller gear is positioned at the first outer surface 11 of the casing 10. The developing roller gear is fixed to the one end portion of the developing roller shaft 32 without relative rotation therebetween. Hence, rotation of the developing roller gear causes the developing roller shaft 32 to rotate, thereby causing the developing roller body 31 to rotate together with the developing roller shaft 32.

Each developing cartridge 1 further includes a developing electrode 33 (see FIG. 3). The developing electrode 33 is positioned at the second outer surface 12 of the casing 10. The developing electrode 33 is positioned closer to the developing roller 30 in the second direction than the separation cam 50 is to the developing roller 30. Another end portion of the developing roller shaft 32 in the first direction is rotatably supported by the developing electrode 33. The developing roller shaft 32 and the developing electrode 33 are electrically connected to each other. The image-forming apparatus 100 is configured to supply a bias voltage to the developing roller shaft 32 through the developing electrode 33.

Incidentally, the developing roller shaft 32 may not penetrate through the developing roller body 31 in the first direction. For example, the developing roller shaft 32 may extend in the first direction from each end in the first direction of the developing roller body 31.

The developing cartridge 1 further includes a supply roller (not illustrated). The supply roller is positioned inside the casing 10 and at a position between the agitator 20 and the developing roller 30. The supply roller is rotatable about an axis extending in the first direction. Upon receipt of driving force to the developing cartridge 1 from the first driving portion 120, the agitator 20, the developing roller 30 and the supply roller are caused to rotate. Hence, the developing agent accommodated in the casing 10 is supplied to the outer peripheral surface of the developing roller 30 through the supply roller. In this instance, the developing agent is subjected to triboelectric charging between the developing roller 30 and the supply roller. Further, a developing bias voltage is applied to the developing roller shaft 32. Hence, the developing agent is attracted to the outer peripheral surface of the developing roller body 31 because of electrostatic force between the developing roller shaft 32 and the developing agent.

The developing cartridge 1 further includes a layer thickness regulation blade (not illustrated). The layer thickness regulation blade is configured to regulate a thickness of a layer of the developing agent supplied to the outer peripheral surface of the developing roller body 31 into a uniform thickness. Thereafter, the developing agent on the outer peripheral surface of the developing roller body 31 is supplied to the corresponding photosensitive drum 22 of the drawer 2. At this time, the developing agent is transferred from the developing roller body 31 to the photosensitive drum 22 according to an electrostatic latent image formed on the photosensitive drum 22. Thus, the electrostatic latent image becomes a visible image on the outer peripheral surface of the photosensitive drum 22.

The gear portion 40 is positioned at the first outer surface 11 of the casing 10. The gear portion 40 includes a coupling 41 and a plurality of gears. The coupling 41 is rotatable about an axis extending in the first direction. The coupling 41 is configured to receive a driving force from the first driving portion 120 of image-forming apparatus 100. The coupling 41 is positioned closer to the developing roller 30 in the second direction than the separation cam 50 is to the developing roller 30. The coupling 41 has a coupling recess 411 that is recessed inward in the first direction. The drive shaft (not illustrated) of the first driving portion 120 is inserted in the coupling recess 411 in accordance with attachment of the drawer 2, in which the developing cartridges 1 are attached to the respective slots 210, to the housing frame 110 of the image-forming apparatus 100. Thus, the drive shaft of the first driving portion 120 and the coupling 41 are coupled together so as not to rotate relative to each other.

Rotation of the drive shaft causes rotation of the coupling 41, which then causes rotation of the plurality of gears including the developing gear in the gear portion 40. The developing roller 30 thus rotates in accordance with the rotation of the developing gear. The agitator 20 and the supply roller rotate by the rotation of the plurality of gears of the gear portion 40.

Figure 5:
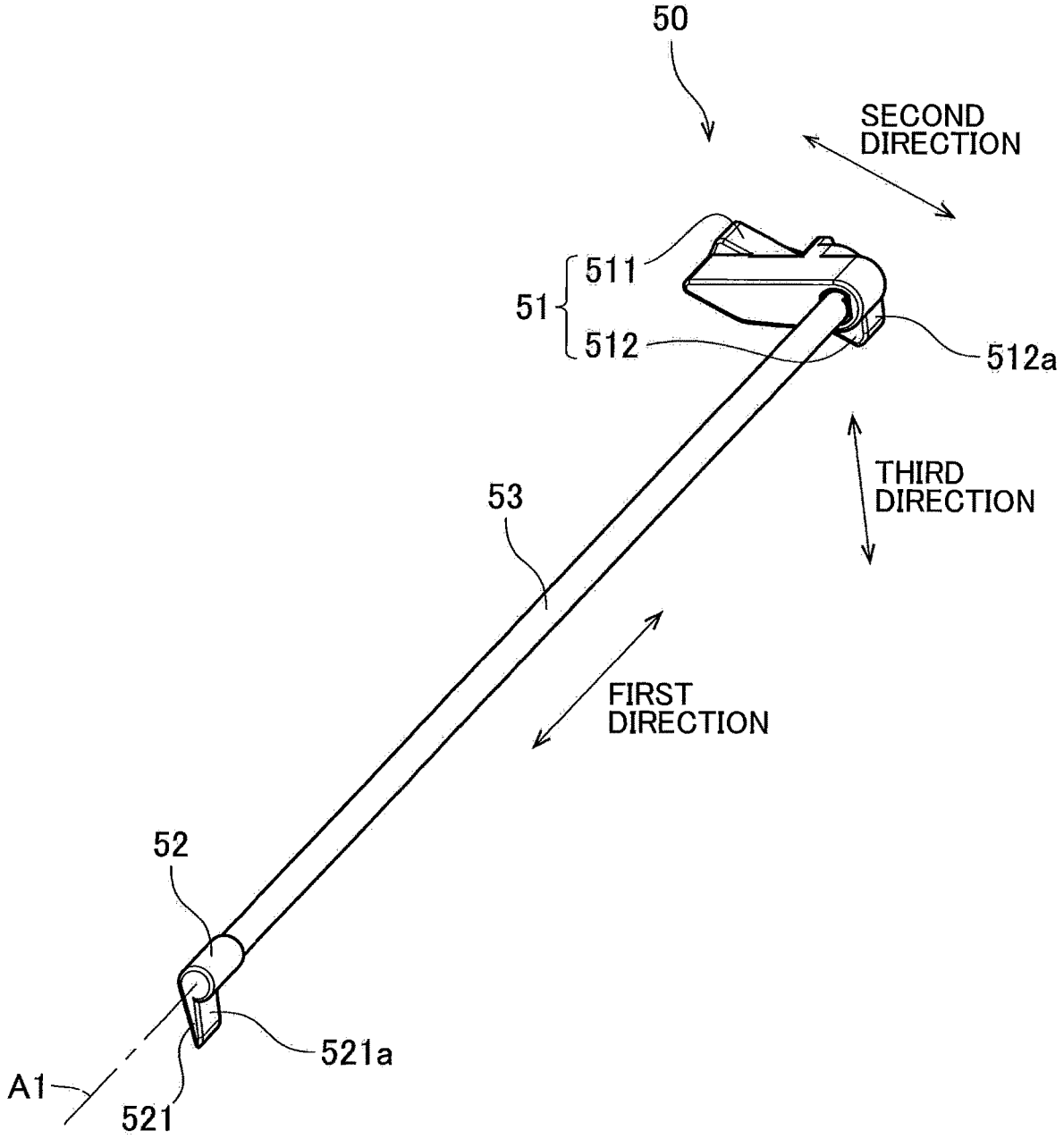
FIG. 5 is a perspective view of a separation cam in the image-forming apparatus according to the embodiment.

The separation cam 50 is a mechanism configured to move the developing roller 30 between a contacting position where the developing roller 30 is in contact with the corresponding photosensitive drum 22 and a separated position where the developing roller 30 is away from the corresponding photosensitive drum 22 in an attached state of the developing cartridge 1 to the corresponding slot 210 of the drawer 2. FIG. 5 is a perspective view of the separation cam 50. As illustrated in FIG. 5, the separation cam 50 includes the first cam 51, a second cam 52 and a shaft 53.

The first cam 51 is positioned at the first outer surface 11 of the casing 10. In other words, the first cam 51 is positioned at one end portion in the first direction of the casing 10. The first cam 51 is pivotally movable about a first axis A1 extending in the first direction between a first position and a second position. The first cam 51 includes a first protrusion 511 and a second protrusion 512.

The first protrusion 511 extends outward from the first axis A1 in the second direction in the attached state of the developing cartridge 1 to the corresponding slot 210. The second protrusion 512 extends from the first axis A1 outward in the third direction in the attached state of the developing cartridge 1 to the corresponding slot 210. The second protrusion 512 has a first pressing surface 512*a*. The first pressing surface 512*a* is part of an outer surface of the second protrusion 512 facing in the second direction. In the state where the developing cartridge 1 is attached to the corresponding slot 210 of the drawer 2, the first pressing surface 512*a* faces a surface of the first side frame 211 in the second direction.

The second cam 52 is positioned at the second outer surface 12 of the casing 10. In other words, the second cam 52 is positioned at another end portion in the first direction of the casing 10. The second cam 52 is pivotally movable about the first axis A1 between a third position and a fourth position. The second cam 52 includes a third protrusion 521 extending outward from the first axis A1 in the third direction in the attached state of the developing cartridge 1 to the corresponding slot 210. The third protrusion 521 has a second pressing surface 521*a*. The second pressing surface 521*a* is part of an outer surface of the third protrusion 521 facing in the third direction. The second pressing surface 521*a* faces a surface of the second side frame 212 in the second direction in the state where the developing cartridge 1 is attached to the corresponding slot 210 of the drawer 2.

The shaft 53 is a rod-like member extending in the first direction between the one end and the other end of the casing 10. The shaft 53 is rotatable about the first axis A1 which is the pivot axis of the first cam 51 and the second cam 52. The shaft 53 is rotatably supported by the lid portion 14 of the casing 10. Specifically, the lid portion 14 has an elongated hole in which the shaft 53 is inserted. The shaft 53 has one end portion in the first direction to which the first cam 51 is fixed so as not to rotate relative to each other. The shaft 53 has another end portion in the first direction to which the second cam 52 is fixed so as not to rotate relative to each other. Hence, the first cam 51, the second cam 52, and the shaft 53 are movable about the first shaft A1 in an integral manner.

In this way, the separation cam 50 is pivotally movable about the first axis A1 extending in the first direction relative to the casing 10 and the developing roller 30, yet the separation cam 50 is movable together with the casing 10 and the developing roller 30 in the second direction.

4. Second Driving Portion

Next, the second driving portion 130 in the image-forming apparatus 100 will be described in greater details.

Figure 6:
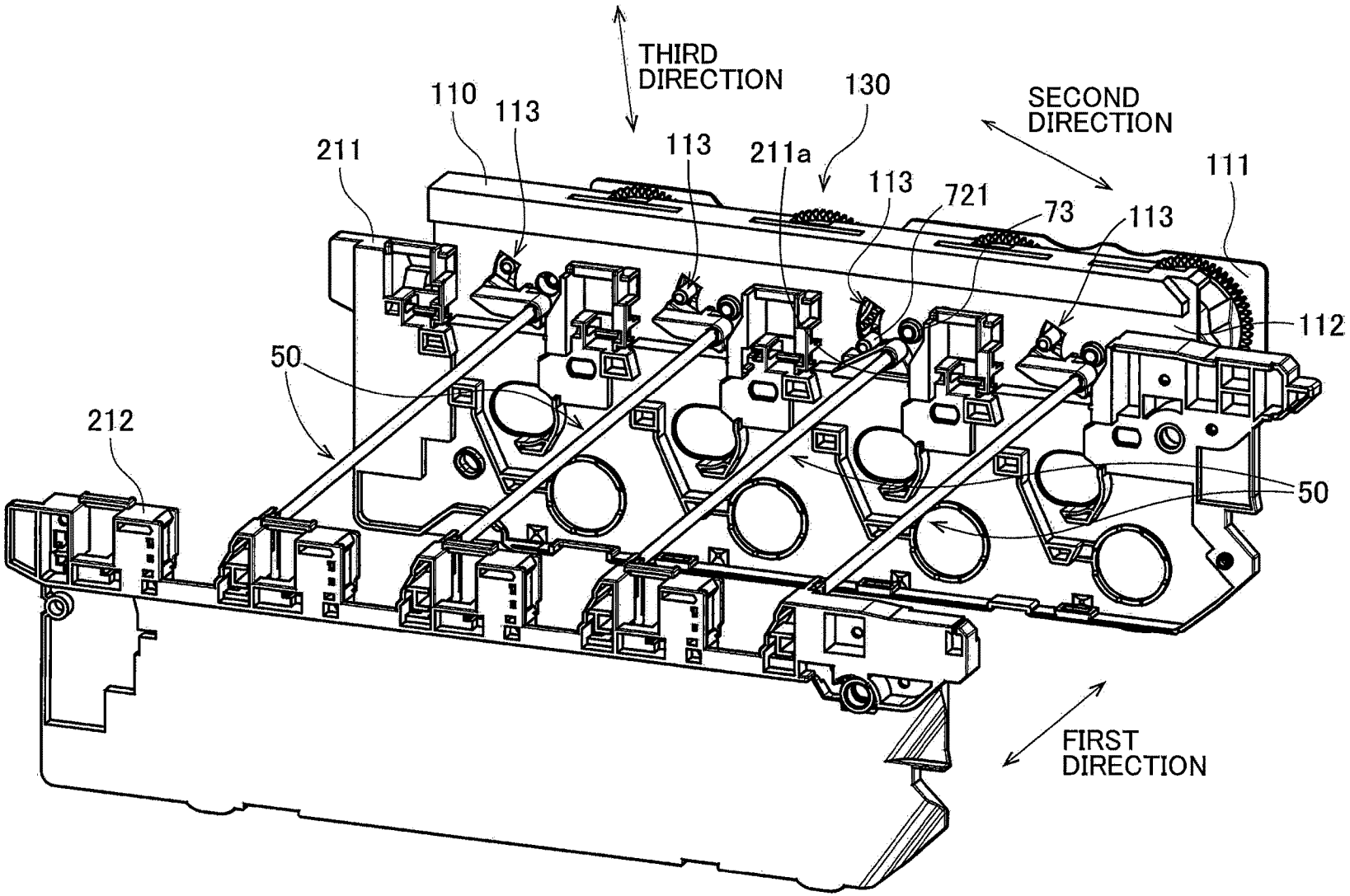
FIG. 6 is a perspective view illustrating four separation cams, a first side frame, a second side frame, and a second driving portion in the image-forming apparatus according to the embodiment.
Figure 7:
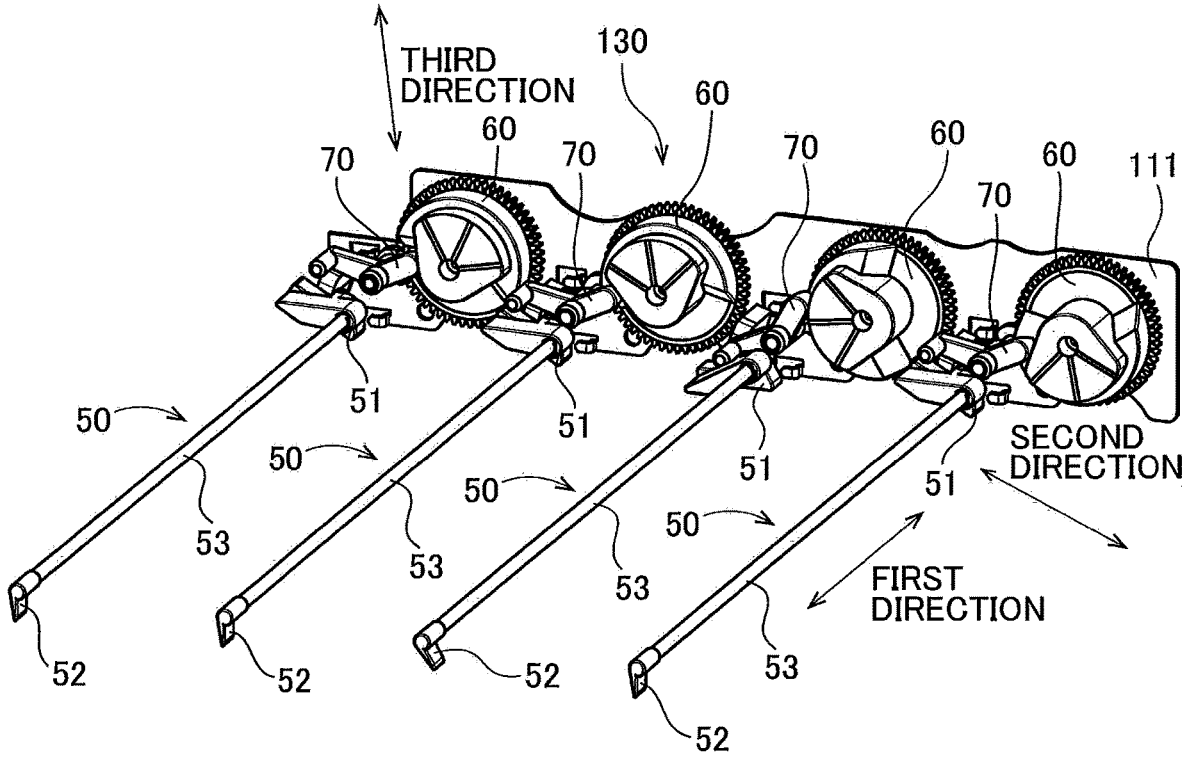
FIG. 7 is a perspective view illustrating the four separation cams and the second driving portion in the image-forming apparatus according to the embodiment.
Figure 8:
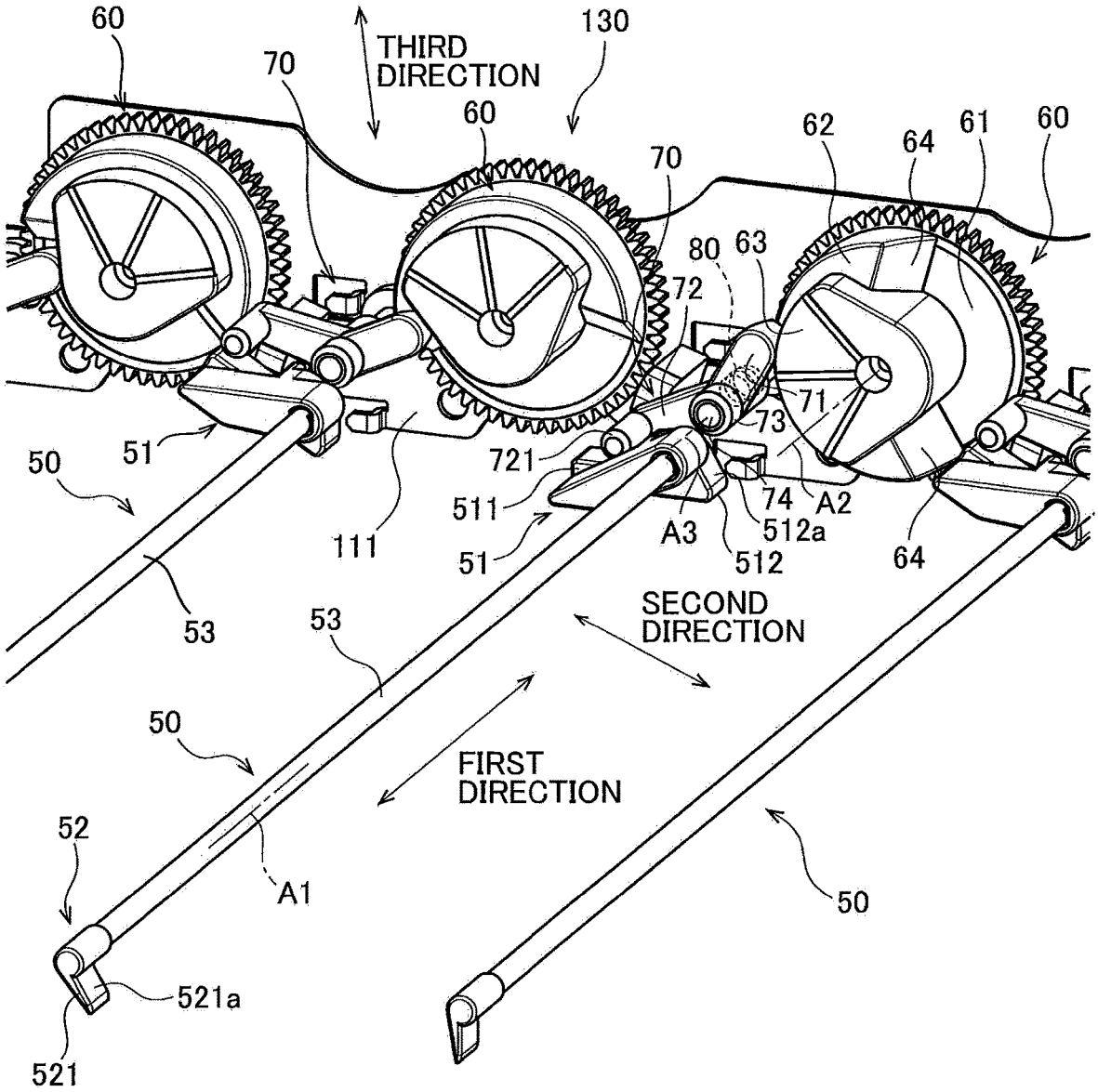
FIG. 8 is an enlarged perspective view illustrating a portion of FIG. 7.

FIG. 6 is a perspective view illustrating the four separation cams 50, the first side frame 211, the second side frame 212, and the second driving portion 130. FIG. 7 is a perspective view illustrating the four separation cams 50 and the second driving portion 130. FIG. 8 is an enlarged perspective view illustrating a portion of FIG. 7.

As illustrated in FIGS. 6 through 8, the second driving portion 130 is not positioned on each side in the first direction of the separation cam 50, but is positioned only at one side in the first direction of the separation cam 50. Specifically, as illustrated in FIG. 6, the housing frame 110 includes a first plate 111 and a second plate 112. The second plate 112 is positioned outward of the drawer 2 in the first direction in the state where the drawer 2 with the developing cartridges 1 attached thereto is attached to the housing frame 110. The first plate 111 is positioned farther outward of the second plate 112 in the first direction. The first plate 111 and the second plate 112 extend in a direction perpendicular to the first direction. The second driving portion 130 is positioned between the first plate 111 and the second plate 112.

In the state where the drawer 2 having the developing cartridges 1 attached thereto is attached to the housing frame 110, the first outer surface 11 of each casing 10 opposes the second driving portion 130 in the first direction via the second plate 112 of the housing frame 110. As illustrated in FIGS. 7 and 8, the second driving portion 130 includes four sets of a cam gear 60, a main-body cam 70, and a coil spring 80.

Each cam gear 60 is a spur gear rotatable about a second axis A2 extending in the first direction. Each cam gear 60 has, on its outer periphery, a plurality of gear teeth. Driving force of the motor (not illustrated) of the second driving portion 130 is configured to be transmitted to the respective cam gears 60 through the plurality of gears of the second driving portion 130, thereby rotating each cam gear 60 about its second axis A2.

Each cam gear 60 has a first cam surface 61, a second cam surface 62, and a sloped surface 64. Each cam gear 60 also includes a cam protrusion 63. The first cam surface 61, the second cam surface 62 and the cam protrusion 63 all face the corresponding developing cartridge 1 in the first direction through the second plate 112. The first cam surface 61 is a sector region whose center is coincident with the second axis A2. The second cam surface 62 is another sector region whose center is coincident with the second axis A2. A central angle of the second cam surface 62 about the second axis A2 is greater than a central angle of the first cam surface 61 about the second axis A. The second cam surface 62 protrudes further inward relative to the first cam surface 61 in the first direction. That is, the second cam surface 62 is positioned closer to the first cam 51 of the corresponding separation cam 50 in the first direction than the first cam surface 61 is to the first cam 51. The sloped surface 64 extends between the first cam surface 61 and the second cam surface 62 so as to smoothly connect the first cam surface 61 to the second cam surface 62 in a rotational direction of the cam gear 60. The cam protrusion 63 protrudes from the second cam surface 62 in the first direction toward the corresponding developing cartridge 1.

The main-body cam 70 is pivotally movable about a third axis A3 extending in the first direction. The main-body cam 70 is positioned between the separation cam 50 and the cam gear 60 in the state where the drawer 2 with the developing cartridges 1 attached thereto is attached to the housing frame 110. As illustrated in FIG. 8, the main-body cam 70 includes a first arm 71, a second arm 72 and a center sleeve 73.

The center sleeve 73 is a hollow cylindrical portion centered on the third axis A3. The housing frame 110 includes a guide shaft 74 extending along the third axis A3. The guide shaft 74 is inserted inside the center sleeve 73. Specifically, the guide shaft 74 has one end portion in the first direction connected to the first plate 111 of the housing frame 110, and has another end portion in the first direction on which the main-body cam 70 is mounted. The center sleeve 73 is movable relative to the guide shaft 74 in the first direction. That is, the main-body cam 70 is movable in the first direction relative to the housing frame 110. The main-body cam 70 is movable in the first direction along the guide shaft 74 between a retracted position and a protruding position closer to the corresponding developing cartridge 1 than the retracted position is to the developing cartridge 1.

Incidentally, at the retracted position, the main-body cam 70 is supported relative to the first plate 111 by the one end portion in the first direction of the guide shaft 74. On the other hand, at the protruding position, the main-body cam 70 is supported relative to the first plate 111 by the other end portion in the first direction of the guide shaft 74, while a part of an outer peripheral surface of the center sleeve 73 is in contact with the second plate 112, as illustrated in FIGS. 6 and 8. Specifically, the second plate 112 has holes, and the part of the outer peripheral surface of the center sleeve 73 is in contact with an inner peripheral surface of the corresponding hole.

Hence, the main-body cam 70 is supported with respect to the housing frame 110 by the two end portions of the center sleeve 73 in the first direction, i.e., an inner peripheral surface of the one end portion in the first direction of the center sleeve 73 and an outer peripheral surface of the other end portion in the first direction of the center sleeve 73. Thus, the main-body cam 70 can be stably supported relative to the housing frame 110 even in a case where rotational moment is applied to the main-body cam 70 at the protruding position thereof.

The first arm 71 extends from the center sleeve 73 radially outward toward the cam gear 60. The first arm 71 has a tip end portion contactable with the first cam surface 61 and the second cam surface 62 of the cam gear 60. Specifically, the tip end portion of the first arm 71 is contactable with the first cam surface 61 of the cam gear 60 at the retracted position of the main-body cam 70, and the tip end portion is contactable with the second cam surface 62 at the protruding position of the main-body cam 70.

The second arm 72 extends from the center sleeve 73 radially outward toward the first protrusion 511 of the corresponding first cam 51. The second arm 72 includes a cam pin 721. The cam pin 721 protrudes in the first direction toward the first cam 51 from a tip end portion of the second arm 72.

As illustrated in FIG. 6, the second plate 112 of the housing frame 110 has four through-holes 113 each extending through a thickness of the second plate 112 in the first direction. The main-body cam 70 in its entirety is positioned between the first plate 111 and the second plate 112 at the retracted position of the main-body cam 70. Hence, the drawer 2 can be attached to and detached from the housing frame 110 without interference with the main-body cam 70. In this state, the cam pin 721 cannot contact the corresponding first cam 51.

On the other hand, at the protruding position of the main-body cam 70, the cam pin 721 is inserted in the corresponding through-hole 113 of the second plate 112. A tip end portion of the cam pin 721 protrudes inward into the drawer 2 through the corresponding through-hole 113. The tip end portion of the cam pin 721 thus becomes contactable with the corresponding first cam 51.

The coil spring 80 is a resilient member capable of expanding and contracting in the first direction. The coil spring 80 is expandable and shrinkable in the first direction between a first length and a second length greater than the first length. The coil spring 80 has one end portion in the first direction connected to the housing frame 110, and another end portion in the first direction connected to the main-body cam 70. The coil spring 80 is interposed between the housing frame 110 and the main-body cam 70 with an expanding length in the first direction greater than a natural length thereof. Hence, the coil spring 80 normally applies urging force to the main-body cam 70 to urge the main-body cam 70 toward the retracted position. Incidentally, instead of the coil spring 80, other resilient members or elastic members such as a torsion spring and a rubber are available.

5. Separating Operation

Operations for moving the developing roller 30 of the developing cartridge 1 between the contacting position and the separated position will be described hereinafter. In the contacting position, the developing roller 30 is in contact with the corresponding photosensitive drum 22, and, in the separated position, the developing roller 30 is separated away from the corresponding photosensitive drum 22.

Upon attachment of the developing cartridge 1 to the corresponding slot 210 of the drawer 2, the corresponding pressure mechanism 23 of the drawer 2 presses the casing 10 of the developing cartridge 1 in the second direction. The outer peripheral surface of the developing roller 30 is thus brought into contact with the outer peripheral surface of the corresponding photosensitive drum 22. That is, the developing roller 30 is brought to the contacting position in contact with the photosensitive drum 22. At this time, the corresponding main-body cam 70 of the second driving portion 130 is at the retracted position, and the tip end portion of the first arm 71 is in contact with the first cam surface 61 of the cam gear 60.

In the image-forming apparatus 100, the second driving portion 130 is actuated for moving each developing roller 30 from the contacting position to the separated position. Specifically, the motor of the second driving portion 130 is actuated so that the driving force of the motor is transmitted to the cam gear 60 through the remaining gears of the second driving portion 130. The cam gear 60 is therefore caused to rotate about the second axis A2, by which rotation a point of contact of the cam gear 60 with the first arm 71 is changed from the first cam surface 61 to the second cam surface 62 via the sloped surface 64. Accordingly, the main-body cam 70 is caused to move in the first direction from the retracted position to the protruding position, which causes the coil spring 80 to expand from the first length to the second length.

As a result of movement of the main-body cam 70 to the protruding position, the cam pin 721 is inserted into the corresponding through-hole 113 of the second plate 112 to cause the tip end portion of the cam pin 721 to protrude inside the drawer 2 through the corresponding through-hole 113.

Subsequently, in accordance with further rotation of the cam gear 60, the cam protrusion 63 of the cam gear 60 is brought into abutment with the first arm 71 of the main-body cam 70 and the first arm 71 is pressed by the cam protrusion 63. The main-body cam 70 is thus caused to pivot about the third axis A3. In accordance with the pivotal movement of the main-body cam 70, the cam pin 721 comes into abutment with the first protrusion 511 of the first cam 51. The first protrusion 511 is pressed by the cam pin 721. As a result, the first cam 51 pivotally moves from the first position to the second position about the first axis A1.

The pivotal movement of the first cam 51 causes the second protrusion 512 of the first cam 51 to pivot about the first axis A1. Hence, the first pressing surface 512*a* of the second protrusion 512 moves in the second direction. Further, in accordance with the pivotal movement of the first cam 51, the shaft 53 is caused to rotate to pivotally move the second cam 52 about the first axis A1. Hence, the third protrusion 521 of the second cam 52 is caused to pivot about the first axis A1 so that the second pressing surface 521*a* of the third protrusion 521 moves in the second direction.

In this way, the first pressing surface 512*a* of the first cam 51 is brought into contact with the first side frame 211 of the drawer 2 in the second direction. Specifically, the first side frame 211 has four first depressed surfaces 211*a* each facing in the second direction (see FIG. 6). The first pressing surface 512*a* of the first cam 51 is brought into contact with the corresponding first depressed surface 211*a*. Further, the second pressing surface 521*a* of the second cam 52 is brought into contact with the second side frame 212 of the drawer 2 in the second direction. Specifically, the second side frame 212 has four second depressed surfaces (not shown) each facing in the second direction. The second pressing surface 521*a* of the second cam 52 is brought into contact with the corresponding second depressed surface.

Since the first pressing surface 512*a* presses the first side frame 211 in the second direction and the second pressing surface 521*a* presses the second side frame 212 in the second direction, the developing cartridge 1 is caused to move in the second direction relative to the drawer 2. At this time, the developing cartridge 1 is caused to move in the second direction against pressing force of the corresponding pressure mechanism 23. In accordance with the movement of the developing cartridge 1 in the second direction, the developing roller 30 moves in a direction away from the photosensitive drum 22. As a result, the outer peripheral surface of the developing roller 30 is separated from the outer peripheral surface of the corresponding photosensitive drum 22. That is, the developing roller 30 moves from the contacting position to the separated position.

In accordance with further rotation of the cam gear 60, the cam protrusion 63 of the cam gear 60 is separated away from the first arm 71 of the main-body cam 70. Hence, the developing cartridge 1 is caused to move toward the corresponding photosensitive drum 22 by the pressing force of the corresponding pressure mechanism 23. The outer peripheral surface of the developing roller 30 is again brought into contact with the outer peripheral surface of the corresponding photosensitive drum 22. That is, the developing roller 30 is again located at the contacting position.

Thereafter, in accordance with further rotation of the cam gear 60, the point of contact of the cam gear 60 with the first arm 71 is changed from the second cam surface 62 to the first cam surface 61 via the sloped surface 64. Accordingly, the main-body cam 70 moves in the first direction from the protruding position to the retracted position. At this time, the coil spring 80 is shrunk from the second length to the first length. As a result of the movement of the main-body cam 70 to the retracted position, the cam pin 721 is withdrawn outward of the drawer 2 through the corresponding through-hole 113 of the second plate 112. Consequently, the main-body cam 70 in its entirety is brought to the position between the first plate 111 and the second plate 112.

As described above, in the image-forming apparatus 100 according to this embodiment, the developing roller 30 is allowed to move from the contacting position to the separated position by the pivotal movement of the first cam 51 positioned at one end portion of the casing 10 in the first direction. Accordingly, the separating operation of the developing roller 30 can be achieved by the driving force from the second driving portion 130 positioned at only one side of the housing frame 110 in the first direction.

Further, the separation cam 50 of the present embodiment not only includes the first cam 51 positioned at the one end portion in the first direction of the casing 10, but also includes the second cam 52 positioned at the other end portion of the casing 10 in the first direction. The first cam 51 and the second cam 52 are pivoted by the driving force from the second driving portion 130 positioned at only one side in the first direction of the housing frame 110. The developing roller 30 is allowed to move from the contacting position to the separated position by the pressing force of the first pressing surface 512*a* of the first cam 51 and the pressing force of the second pressing surface 521*a* of the second cam 52 applied to the drawer 2. With this structure of the embodiment, the developing roller 30 can move without substantial inclination thereof.

Further, according to the structure of the above-described embodiment, driving force from the second driving portion 130 is directly transmitted to the separation cam 50 of each developing cartridge 1. In other words, no intervening components for power transmission is required in the drawer 2 for moving each developing roller 30 from the contacting position to the separated position. Hence, the number of parts required for the drawer 2 can be reduced.

6. Modifications

While the description has been made in detail with reference to the embodiment, it would be apparent to those skilled in the art that various modifications and variations may be made thereto without departing from the scope of the disclosure.

For example, in the above-described embodiment, the first cam 51, the second cam 52 and the shaft 53 are discrete components. However, the first cam 51 and the shaft 53 or the second cam 52 and the shaft 53, or the first cam 51, second cam 52 and shaft 53 may be an integral component. This can reduce power transmission loss and can provide synchronous motion at higher accuracy in comparison with a case where these are discrete components.

Further, the drawer 2 of the depicted embodiment is attachable to and detachable from the housing frame 110 of the image-forming apparatus 100. However, the drawer 2 may not be attachable to and detachable from the housing frame 110 of the image-forming apparatus 100. That is, the drawer 2 may be fixed to the housing frame 110.

A detailed configuration of the image-forming apparatus of the disclosure may be different from that of the above-described embodiment. The elements described in the embodiment and the modifications may be combined with one another appropriately, provided that no technical conflict is incurred.

What is claimed is:

1. A cartridge comprising:

a developing unit comprising:

a developing roller rotatable about a first axis extending in a first direction;

a casing configured to store developing agent therein;

an agitator configured to agitate the developing agent, the agitator being rotatable about a second axis extending in the first direction;

a first cam positioned at one end of the casing in the first direction, the first cam being positioned at one end of the agitator in the first direction, the first cam being pivotally movable about a third axis extending in the first direction between a first position and a second position relative to both the developing roller and the agitator, the third axis extending along both the first axis and the second axis; and a pressing surface pivotable in accordance with pivotal movement of the first cam; and a drum unit comprising:

a photosensitive drum rotatable about an axis extending in the first direction, an outer peripheral surface of the developing roller faces an outer peripheral surface of the photosensitive drum; and a depressed surface with which the pressing surface is contactable, wherein, in response to the pivotal movement of the first cam from the first position to the second position, the pressing surface comes in contact with the depressed surface to move the developing roller from a contacting position in contact with the photosensitive drum to a separated position in separation from the photosensitive drum.

2. The cartridge according to claim 1, wherein the first cam includes the pressing surface.

3. The cartridge according to claim 2, wherein the first cam comprises:

a first protrusion configured to receive a driving force; and a second protrusion having the pressing surface.

4. The cartridge according to claim 3, wherein the first protrusion protrudes in a second direction crossing the first direction, and wherein the second protrusion protrudes in a third direction crossing the first direction and the second direction.

5. The cartridge according to claim 1, wherein the developing unit further comprises a shaft extending in the first direction between the one end of the casing and another end of the casing in the first direction, the shaft being rotatable along with the pivotal movement of the first cam, and wherein, in response to the pivotal movement of the first cam from the first position to the second position, the shaft rotates to bring the pressing surface into contact with the depressed surface to move the developing roller from the contacting position to the separated position.

6. The cartridge according to claim 5, wherein the developing unit further comprises a second cam positioned at the another end of the casing in the first direction, the second cam being pivotally movable in accordance with the pivotal movement of the first cam and the rotation of the shaft, and wherein the first cam and the second cam have the pressing surface.

7. The cartridge according to claim 6, wherein the first cam comprises:

a first protrusion configured to receive a driving force; and a second protrusion having the pressing surface, and wherein the second cam comprises a third protrusion having the pressing surface.

8. The cartridge according to claim 7, wherein the first protrusion extends in a second direction crossing the first direction, and wherein the second protrusion and the third protrusion extend in a third direction crossing the first direction and the second direction.

9. The cartridge according to claim 1, wherein the drum unit includes a plurality of the photosensitive drums, and wherein the drum unit is configured to receive a plurality of the developing units each for a corresponding one of the photosensitive drums.

* * * * *